US011395060B2

(12) United States Patent
Ji et al.

(10) Patent No.: US 11,395,060 B2
(45) Date of Patent: Jul. 19, 2022

(54) RECEIVER HAVING PRESSURE EQUILIBRIUM STRUCTURE

(71) Applicant: EM-TECH Co., Ltd., Gyeongsangnam-do (KR)

(72) Inventors: Yong Ju Ji, Gyeongsangnam-do (KR); Young Woo Kim, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/388,139

(22) Filed: Jul. 29, 2021

(65) Prior Publication Data

US 2022/0038810 A1 Feb. 3, 2022

(30) Foreign Application Priority Data

Jul. 31, 2020 (KR) ..... 10-2020-0095921
Apr. 16, 2021 (KR) ..... 10-2021-0049832

(51) Int. Cl.

| | |
|---|---|
| ***H04R 9/06*** | (2006.01) |
| ***H04R 1/10*** | (2006.01) |
| ***H04R 7/06*** | (2006.01) |
| ***H04R 9/04*** | (2006.01) |
| ***H04R 7/18*** | (2006.01) |
| ***H04R 9/02*** | (2006.01) |

(52) U.S. Cl.

CPC ..... *H04R 1/1083* (2013.01); *H04R 1/1016* (2013.01); *H04R 7/06* (2013.01); *H04R 7/18* (2013.01); *H04R 9/025* (2013.01); *H04R 9/04* (2013.01); *H04R 9/06* (2013.01); *H04R 2209/027* (2013.01); *H04R 2460/11* (2013.01)

(58) Field of Classification Search

CPC .... H04R 1/023; H04R 1/1086; H04R 1/1016; H04R 1/1083; H04R 7/06; H04R 7/18; H04R 9/025; H04R 9/06; H04R 9/04; H04R 2209/027; H04R 2460/11

See application file for complete search history.

(56) References Cited

U.S. PATENT DOCUMENTS

| | | | | |
|---|---|---|---|---|
| 6,804,366 B2 * | 10/2004 | Takahashi | H04R 9/06 381/430 |
| 2014/0056455 A1 * | 2/2014 | Sakaguchi | H04R 1/2811 381/328 |
| 2017/0238088 A1 * | 8/2017 | Wen | H04R 1/2819 381/373 |

FOREIGN PATENT DOCUMENTS

| | | |
|---|---|---|
| KR | 20020015633 A | 2/2002 |
| KR | 101177322 B1 | 8/2012 |

* cited by examiner

*Primary Examiner* — Huyen D Le
(74) *Attorney, Agent, or Firm* — Murphy, Bilak & Homiller, PLLC

(57) ABSTRACT

A receiver having a pressure equilibrium structure includes a magnetic circuit including a yoke, a permanent magnet coupled to the yoke, and a top plate attached to the permanent magnet, a voice coil configured to vibrate by mutual electromagnetic force with the magnetic circuit, a diaphragm allowing the voice coil to be attached thereto and vibrated by the voice coil to generate sound, and a protector coupled to an upper surface of the diaphragm and surrounding an outer side of the magnetic circuit with a gap from an outer periphery of the magnetic circuit, wherein the protector has a hole communicating with a gap portion with the magnetic circuit and an air path is formed by the hole of the protector and the gap between the magnetic circuit and the protector.

15 Claims, 14 Drawing Sheets

B - B

A - A

B - B

RECEIVER HAVING PRESSURE EQUILIBRIUM STRUCTURE

TECHNICAL FIELD

The present disclosure relates to a receiver having a pressure equilibrium structure.

BACKGROUND

An adaptive noise canceling (ANC) function is a technology for canceling ambient noise using a reverse wavelength of noise, which allows a user to focus on sound quality more by blocking ambient noise when wearing earphones. Noise generally has a large portion in a low frequency range. Therefore, as a condition for realizing an excellent ANC function, noise in the low frequency range is collected by several microphones and an offset sound wave of a reverse phase is generated to cancel ambient noise.

Earphones are classified into closed type earphones in which all other portions, excluding a sound emission hole inserted into an ear canal, are blocked and open type earphones including a tuning hole and a duct in addition to a sound emission hole.

The closed type earphone is to deliver sound of a receiver installed in the earphone directly to the user's ear, enabling listening to sound even with small power. In particular, a kernel-type earphone inserted into the user's ear through an earpiece includes excellent sound insulation properties that block external noise.

However, in the case of a kernel-type earphone, as the ear canal is completely sealed, a pressure difference is made between the inside and outside of the ear canal, and thus, some may feel pressure in the ears or the others may feel uncomfortable.

FIG. 1 is a view illustrating a kernel-type earphone equipped with a pressure equilibrium means according to the related art. The kernel-type earphone according to the related art a speaker unit 1 and a housing accommodating the speaker unit 1 and including a front housing 10 and a rear housing 20. The speaker unit 1 installed inside the housing includes a cylindrical frame, a magnetic circuit installed inside the frame, and a diaphragm vibrating up and down by magnetic force of the magnetic circuit. The frame, that is, an exterior of the speaker unit 1, includes a cylindrical shape, and an inner circumferential surface of the front housing 10 and an outer circumferential surface of the speaker unit 1 are in contact with the speaker unit 1 so that the speaker unit seals a portion between the front and the rear of the speaker unit within the front housing 10.

Here, the kernel-type earphone forms a sound tube 12 in front of the front housing 10, and a sealed ear tip formed of rubber or sponge material is mounted on the sound tube 12. Therefore, the kernel-type earphone seals the ear canal and the outside, so that when the kernel-type earphone is worn and used, air is sealed around the ear canal and air is compressed in the ear. The compressed air in the ear compresses the eardrum, causing a feeling of stuffiness and discomfort. Therefore, an intentional leakage hole is required to attenuate hearing and leak air pressure.

In the case of the related art, a leakage hole 14 for leaking air from the front of the diaphragm to the front of the front housing 10 is installed as shown in FIG. 1, a leakage hole 14*a* that leaks air in front of the diaphragm to the side of the front housing 10*a* is installed as shown in FIG. 2, or air from the front of the diaphragm is leaked to the rear housing 20 by way of the rear of the front housing 10*a* through a duct 14*b*.

The pressure equilibrium structure according to the related art needs to have a shape for pressure equilibrium in the front housing 10 of the earphone, resulting in a limitation in the shape of the earphone itself.

SUMMARY

An aspect of the present disclosure provides a receiver having a pressure equilibrium structure capable of achieving pressure equilibrium only by the receiver itself.

According to an aspect of the present disclosure, a receiver having a pressure equilibrium structure includes: a magnetic circuit including a yoke, a permanent magnet coupled to the yoke, and a top plate attached to the permanent magnet; a voice coil vibrated by mutual electromagnetic force with the magnetic circuit; a diaphragm allowing the voice coil to be attached thereto and vibrated by the voice coil to generate sound; and a protector coupled to an upper surface of the diaphragm and surrounding an outer side of the magnetic circuit with a gap from an outer periphery of the magnetic circuit, wherein the protector has a hole communicating with a gap portion with the magnetic circuit and an air path is formed by the hole of the protector and the gap between the magnetic circuit and the protector.

Also, as another example of the present disclosure, the receiver may further include a mesh covering a pressure equilibrium hole of the protector.

According to another aspect of the present disclosure, a receiver having a pressure equilibrium structure includes: a cylindrical frame having a gap for accommodating a component; a yoke partitioning an internal space of the frame vertically and including a bottom surface, a cylindrical portion bent from the bottom surface, a flange portion formed on an outer circumference of the cylindrical portion, and a communication hole formed by removing a portion of the flange portion; a first speaker unit installed above the yoke and including a first permanent magnet, a first plate, a first voice coil, and a first diaphragm; a second speaker unit installed below the yoke and including a second permanent magnet, a second plate, a second voice coil, and a second diaphragm; a first protector coupled to an upper surface and a side surface of the frame and protecting the first speaker unit; and an air path formed by removing portions of the upper surface and the side surface of the frame to have a gap from the first protector, wherein the first protector has a pressure equilibrium hole communicating with the air path.

Also, as another example of the present disclosure, the receiver may further include: a mesh attached to the pressure equilibrium hole of the first protector.

Also, as another example of the present disclosure, the first protector may include a second sound emission hole communicating with the communication hole of the yoke.

Also, as another example of the present disclosure, the receiver may further include: a third plate attached to an upper surface of the flange portion of the yoke and helping to install the first diaphragm.

Also, as another example of the present disclosure, the first protector may include a side surface coupled to the side surface of the frame; an upper surface attached to the upper surface of the frame and an outer periphery of the first diaphragm, and a step portion protruding upward to avoid interference with the first diaphragm.

Also, as another example of the present disclosure, the step portion may have a first sound emission hole emitting sound reproduced by the first diaphragm.

Also, as another example of the present disclosure, the first protector may include a side surface coupled to the side surface of the frame and an upper surface coupled to the upper surface of the frame and an outer periphery of the diaphragm.

Also, as another example of the present disclosure, the receiver may further include: a second protector attached to the side surface of the frame and a lower surface of the second diaphragm and protecting the second speaker unit.

Also, as another example of the present disclosure, the first protector may surround only a portion of an upper side of the side surface of the frame.

Also, as another example of the present disclosure, a cross-section and a volume of a portion of the frame not surrounded by the first protector and at least a portion of the second speaker unit may be determined irrespective of the first protector.

According to another aspect of the present disclosure, a receiver having a pressure equilibrium structure includes: a cylindrical frame having a gap for accommodating a component; a yoke partitioning an internal space of the frame vertically and including a bottom surface, a cylindrical portion bent from the bottom surface, a flange portion formed on an outer circumference of the cylindrical portion, and a communication hole formed by removing a portion of the flange portion; a first speaker unit installed above the yoke and including a first permanent magnet, a first plate, a first voice coil, and a first diaphragm; a second speaker unit installed below the yoke and including a second permanent magnet, a second plate, a second voice coil, and a second diaphragm; a first protector coupled to an upper surface and a side surface of the frame and including a sound emission hole protecting the first speaker unit and emitting sound and a pressure equilibrium hole formed by removing a portion of a sidewall to a lower end; and an air path having a gap with the first protector by removing portions of the upper surface and the side surface of the frame, and extending from the sound emission hole to the pressure equilibrium hole.

Also, as another example of the present disclosure, the frame may have a guide protrusion inserted into a lower end of a recess, and the pressure equilibrium hole may be defined by a removed recess of the first protector.

Also, as another example of the present disclosure, the receiver may further include: a mesh attached to the pressure equilibrium hole and adjusting an amount of ventilation.

The receiver according to the present disclosure has an air path for pressure equilibrium alone, and thus, a shape of the earphone is not limited.

In addition, the receiver according to the present disclosure does not require a separate component for the air path, and thus, the inside may be efficiently designed, which brings positive effects such as a reduction in a defect rate and shortening of a process time in production.

Those skilled in the art will recognize additional features and advantages upon reading the following detailed description, and upon viewing the accompanying drawings.

DETAILED DESCRIPTION

Hereinafter, the present disclosure will be described in detail with reference to the accompanying drawings.

Figure 1:
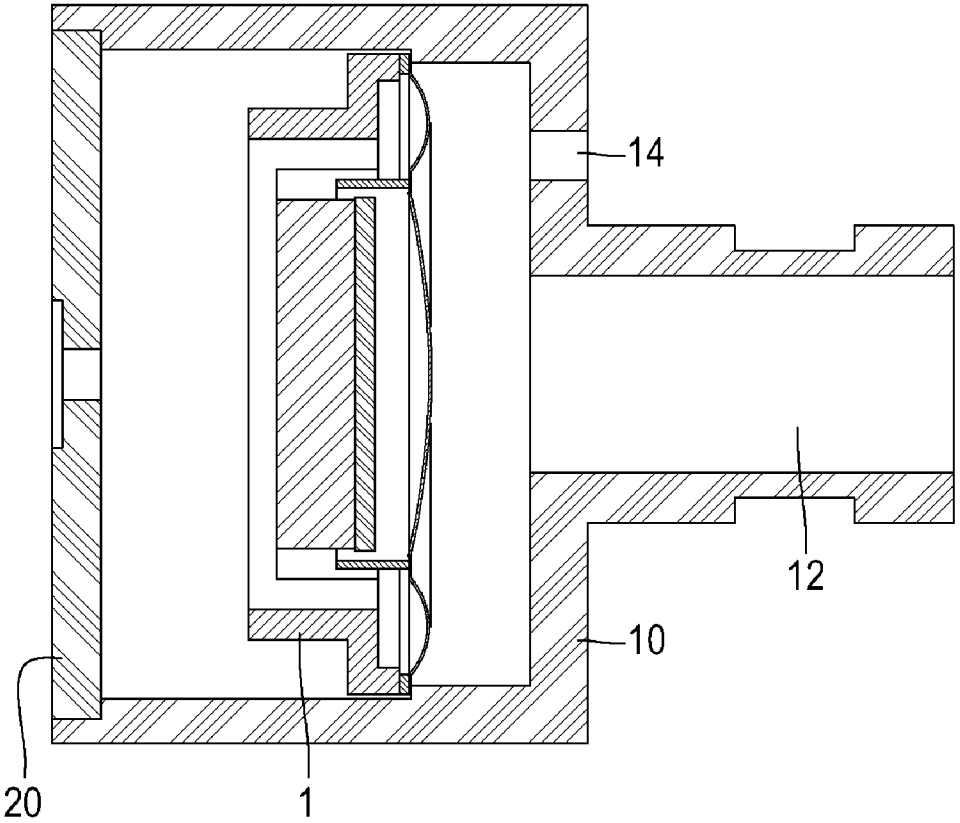
FIG. 1 is a view illustrating a kernel-type earphone equipped with a pressure equilibrium means according to a related art.
Figure 2:
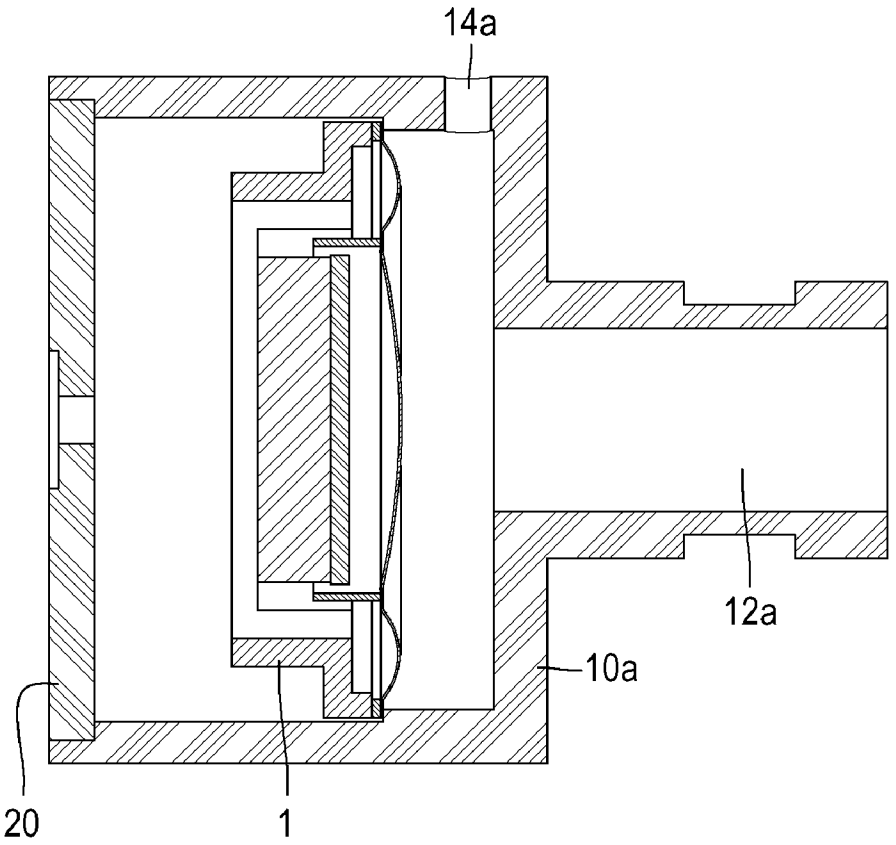
FIG. 2 is a view illustrating a kernel-type earphone equipped with a pressure equilibrium means according to another related art.
Figure 3:
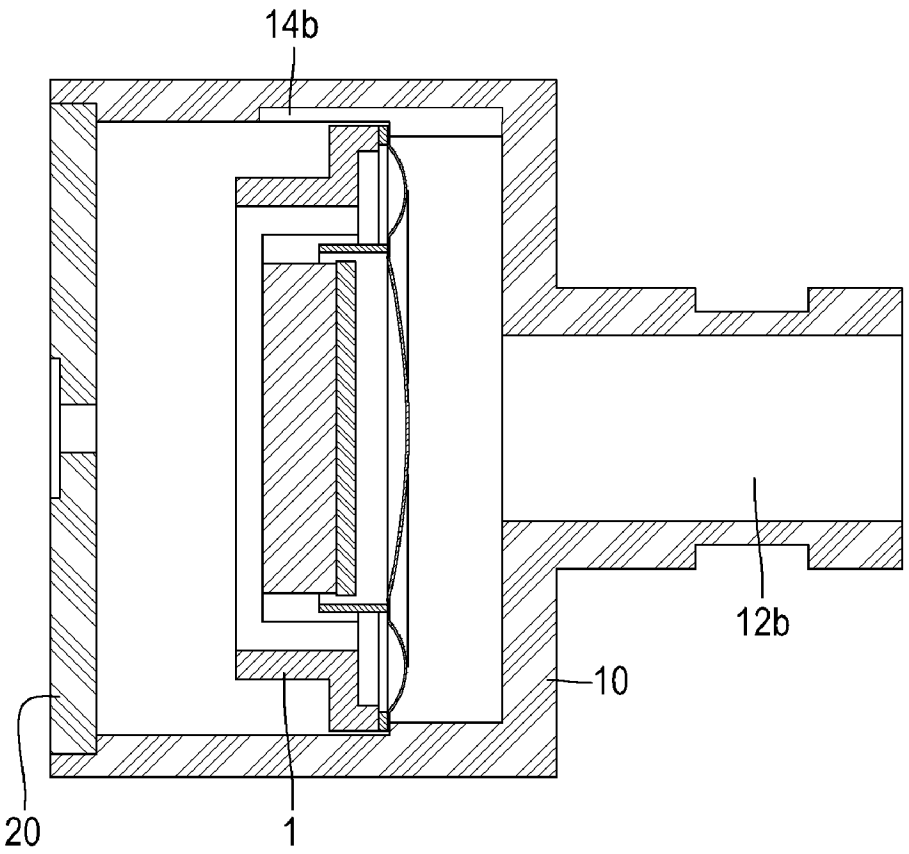
FIG. 3 is a view illustrating a kernel-type earphone equipped with a pressure equilibrium means according to another related art.
Figure 4:
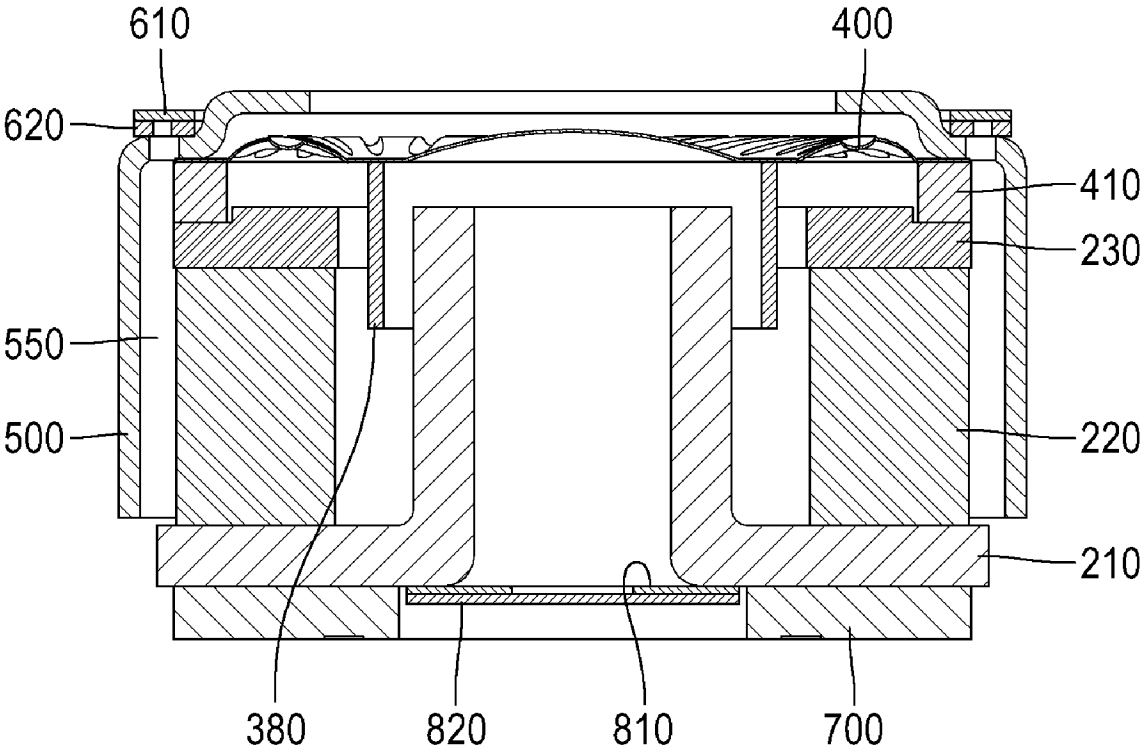
FIG. 4 is a cross-sectional view of a receiver having a pressure equilibrium structure according to a first embodiment of the present disclosure.
Figure 5:
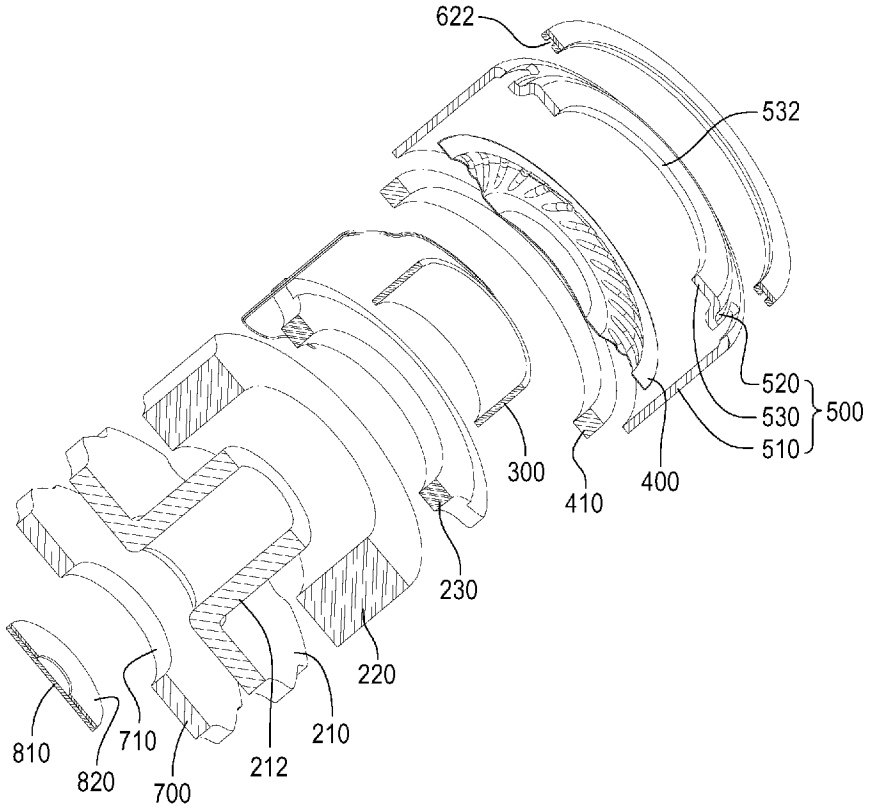
FIG. 5 is an exploded view of a receiver having a pressure equilibrium structure according to the first embodiment of the present disclosure.

FIG. 4 is a cross-sectional view of a receiver having a pressure equilibrium structure according to a first embodiment of the present disclosure, and FIG. 5 is an exploded view of a receiver having a pressure equilibrium structure according to the first embodiment of the present disclosure.

A receiver having a pressure equilibrium structure according to the first embodiment of the present disclosure includes a magnetic circuit including a yoke 210 having a hollow pole 212 formed in the center, a hollow type permanent magnet 220 attached to the yoke 210 with a predetermined from the pole 212, and a top plate 230 attached to an upper surface of the permanent magnet 220. A lower end of a voice coil 300 is positioned in an air gap provided between the pole 212 and the permanent magnet 220, and an upper end of the voice coil is attached to a diaphragm 400. When a signal is applied to the voice coil 300, the voice coil 300 vibrates up and down by mutual electromagnetic force with the magnetic circuit according to the signal, and the diaphragm 400 to which the upper end of the voice coil 300 is attached also vibrates and generates sound.

Since the diaphragm 400 is formed of a polymer film, a ring 410 of injection molding material may be attached to an outer circumference of the diaphragm 400 in order to improve difficulty in handling during assembly. The ring 410 is attached to a top plate 230.

Meanwhile, a protector 500 is coupled to an upper surface of the diaphragm 400 and encases the outside of the magnetic circuit with a gap 550 with an outer periphery of the magnetic circuit is provided. This gap 550 is used as an air path for pressure equilibrium between a front and a rear of the receiver.

The protector 500 includes a cylindrical sidewall 510 positioned at a distance from the outer periphery of the magnetic circuit and an upper surface 520 bent inwardly and extended from an upper end of the sidewall 510. The upper surface 520 is attached to the outer circumferential surface of the diaphragm 400. In addition, in order to avoid interference between the diaphragm and the protector 500 when the diaphragm 400 vibrates, the protector 500 includes a step portion 530 protruding upward from an inner side of the upper surface 520.

Here, the upper surface 520 of the protector 500 has a pressure equilibrium hole 522 that may communicate with the gap 550 between the sidewall 510 and the magnetic circuit. The pressure equilibrium hole 530 is located on an outer side than a contact portion between the protector 500 and the diaphragm 400. In addition, a sound emission hole 532 is provided in the center of the step portion 530 to emit sound reproduced by the diaphragm 400. Here, since the upper surface 520 is attached to the outer periphery of the diaphragm 400, the pressure equilibrium hole 522 and the sound emission hole 532 do not communicate with each other.

Meanwhile, a mesh 610 may be attached to the upper surface 520 of the protector 500. The mesh 610 may adjust the amount of air introduced through the pressure equilibrium hole 530 by adjusting a sieve scale. The mesh 610 may be attached to the protector 500 by an adhesive member such as a double-sided tape 620. Here, the double-sided tape 620 is not ventilated, and thus, a perforation 622 is provided so as not to cover the pressure equilibrium hole 530.

In addition, a circuit board 700 for transmitting an electrical signal to the voice coil 300 may be disposed on a lower surface of the yoke 210. In the circuit board 700, a back hole 710 is formed in a position corresponding to the hollow pole 212 of the yoke 210 not to prevent air from entering and exiting a rear surface of the diaphragm 400. A mesh 810 may be attached to the back hole 710 by a double-sided tape 820, and the double-sided tape 820 is perforated so as not to block the back hole 710. The mesh 810 attached to the back hole 710 may control the amount of air introduced through the back hole 710.

Figure 6:
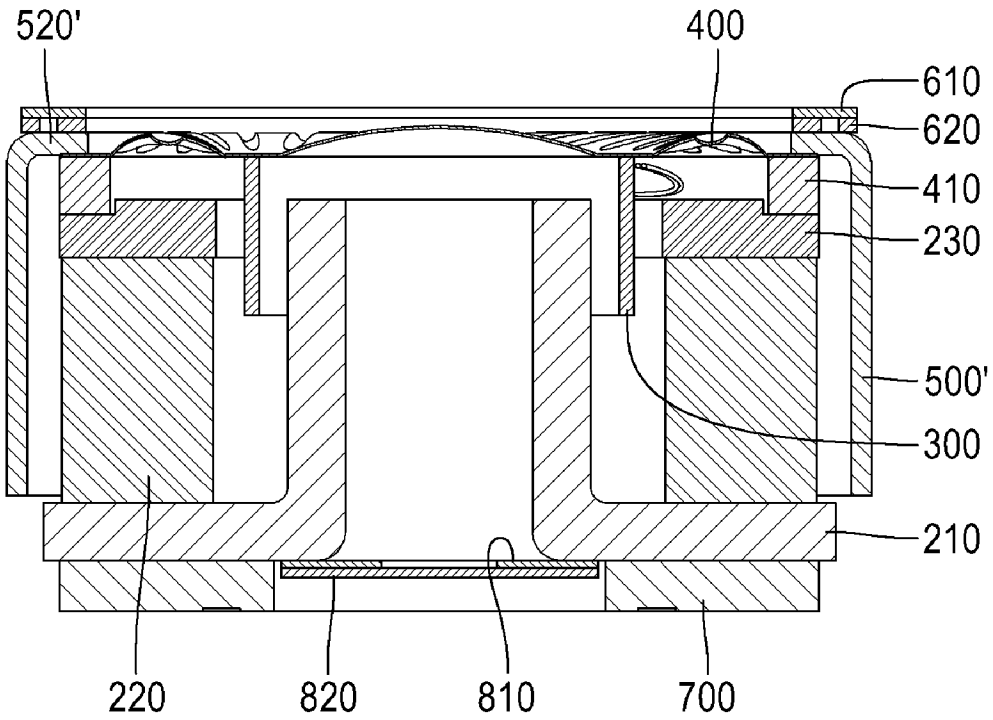
FIG. 6 is a cross-sectional view of a receiver having a pressure equilibrium structure according to a second embodiment of the present disclosure.

FIG. 6 is a cross-sectional view of a receiver having a pressure equilibrium structure according to a second embodiment of the present disclosure.

In the first embodiment of the present disclosure, the protector 500 includes a step portion 530 (refer to FIG. 5), but as in the second embodiment, a protector 500' may not have the step portion 530 (refer to FIG. 5) separately, and an upper surface 520' may extend only to a position in contact with the outer circumferential surface of the diaphragm 400.

Figure 7:
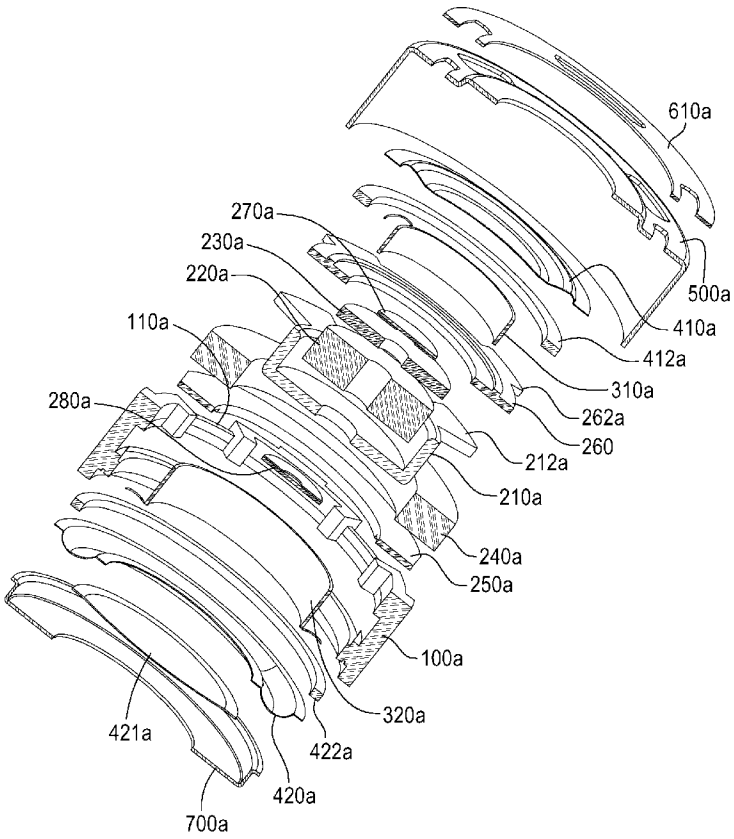
FIG. 7 is an exploded view of a receiver having a pressure equilibrium structure according to a third embodiment of the present disclosure.
Figure 8:
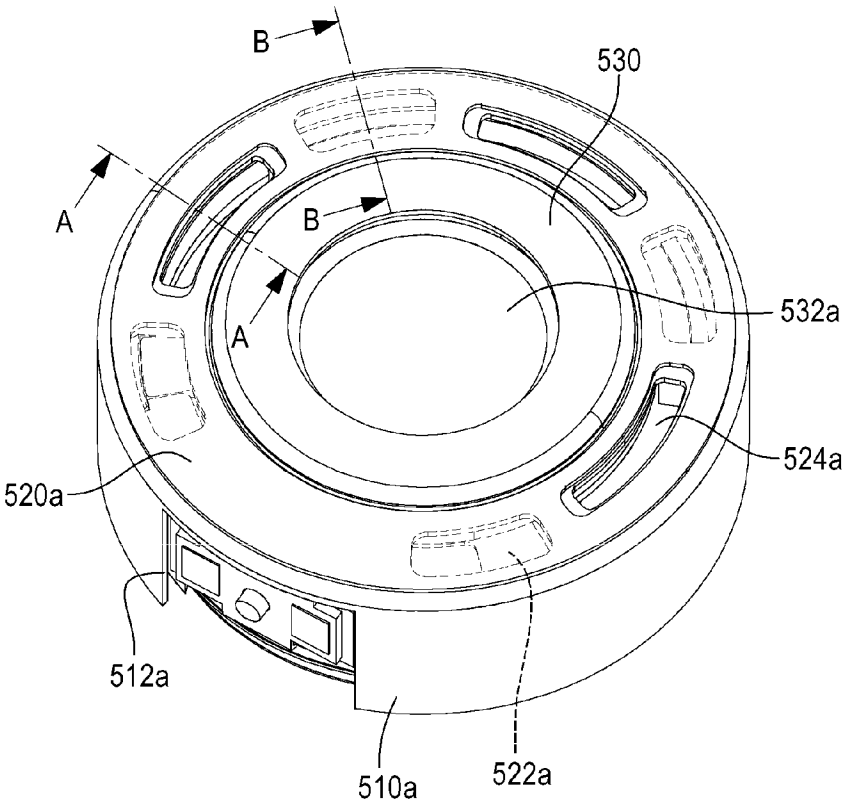
FIG. 8 is a perspective view of a receiver having a pressure equilibrium structure according to the third embodiment of the present disclosure.

FIG. 7 is an exploded view of a receiver having a pressure equilibrium structure according to a third embodiment of the present disclosure, and FIG. 8 is a perspective view of a receiver having a pressure equilibrium structure according to the third embodiment of the present disclosure.

The receiver having a pressure equilibrium structure according to the third embodiment of the present disclosure includes a magnetic circuit and a vibration unit in a cylindrical frame 100*a*. The frame 100*a* includes a yoke 210*a* partitioning an internal space of the frame 100*a* up and down. Based on the yoke 210*a* as a boundary, a first speaker unit is installed above the yoke 210*a*, and a second speaker unit is installed below the yoke 210*a*.

The yoke 210*a* includes a circular bottom surface, a cylindrical portion bent from the bottom surface, a flange portion formed on an outer circumference of the cylindrical portion, and a communication hole 212*a* formed by removing a portion of the flange portion. Meanwhile, the frame 100*a* includes a pressure equilibrium groove 110*a* formed by removing an outer portion to avoid the position of the communication hole 212*a* of the yoke 210*a*.

A first speaker unit is installed above the yoke 210*a*, and the first speaker unit includes a first permanent magnet 220*a* attached to a bottom surface, a first top plate attached to an upper surface of the first permanent magnet 220*a*, a first voice coil 310*a*, and a first diaphragm 410*a*. An outer circumference of the first permanent magnet 220*a* and the first top plate 230*a* is formed to be spaced apart from the cylindrical portion of the yoke 210*a*, and this space is a first magnetic gap. The lower end of the first voice coil 310*a* is positioned in the magnetic gap. The upper end of the first voice coil 310*a* is attached to the first diaphragm 410*a*, and the first diaphragm 410*a* vibrates according to vibration of the first voice coil 310*a* to generate sound. The first diaphragm 410*a* is attached to the flange portion of the yoke 210*a*. In this case, a guide ring 412*a* may be attached to an edge of the first diaphragm 410*a* to facilitate installation of the first diaphragm 410*a*. Since the first diaphragm 410*a* is thin and difficult to handle, a guide ring 412*a* formed of an injection molded product or metal having a thickness and rigidity greater than those of the first diaphragm 410*a* may be attached to facilitate installation of the first diaphragm 410*a*. A third plate 260*a* may be additionally attached to the flange portion. The third plate 260*a* is a magnetic structure for compensating for magnetic flux leakage occurring in the bent portion between the cylindrical portion and the flange portion of the yoke. The third plate 260*a* is attached to an inner side on the flange portion and has a rib structure thereon to guide a position of the guide ring 412*a*, so that the third plate 260*a* may also serve to guide the installation position of the first diaphragm 410*a*.

Meanwhile, a second speaker unit is installed below the yoke 210*a*. The second speaker unit includes a second permanent magnet 240*a* positioned on a lower surface of the flange portion of the yoke 210*a* and a second top plate 250*a* attached to a lower surface of the second permanent magnet 240*a*. In this case, the second permanent magnet 240*a* and the second top plate 250*a* may be insert-injected during injection molding of the frame 100*a*. Here, the second permanent magnet 240*a* and the second top plate 250*a* have a ring shape, and an inner periphery is installed to be spaced apart from the cylindrical portion of the yoke 210*a*, and this space is a second magnetic gap. An upper end of the second voice coil 320*a* is positioned in the second magnetic gap, and a lower end of the second voice coil 320*a* is attached to the second diaphragms 420*a* and 421*a*. The outer periphery of the second diaphragms 420*a* and 421*a* is seated on the lower surface of the frame 100*a*. A guide ring 422*a* may be attached to the edge of the second diaphragms 420*a* and 421*a* to facilitate installation of the second diaphragms 420*a* and 421*a*. The guide ring 422*a* is guided by a shape of the inner circumferential surface of the frame 100*a* to match the concentricity of the second diaphragms 420*a* and 421*a*.

In addition, a second protector 700*a* for protecting the second speaker unit may be installed below the second speaker unit. An outer circumferential surface of the second protector 700*a* positioned on a lower surface of the second diaphragm 420*a* and the second guide ring 422*a* is in contact with the inner circumferential surface of the frame 100*a* to guide the installation position.

As described above, the yoke 210*a* includes a communication hole 212*a* formed by removing a portion of the flange portion. Sound generated by the second speaker unit is emitted upward through the communication hole 212*a*.

Meanwhile, the yoke 210*a*, the first permanent magnet 220*a*, and the first top plate 230*a* are perforated in the center and serve as a back hole. Accordingly, the first diaphragm 410*a* may vibrate smoothly. In this case, meshes 270*a* and 280*a* covering the perforations may be attached to the upper surface of the first top plate 230*a* and the lower surface of the yoke 210*a*, respectively.

Referring to FIG. 8, a first protector 500*a* provided in the receiver having a pressure equilibrium structure according to the third embodiment of the present disclosure is coupled to an outer surface and an upper surface of the frame 100*a*. The first protector 500*a* includes a cylindrical sidewall 510*a* in contact with the outer surface of the frame 100*a* and an upper surface 520*a* bent inwardly and extended from an upper end of the sidewall 510*a*. The upper surface 520*a* is attached to the outer circumferential surface of the first diaphragm 410*a*. In addition, in order to avoid interference between the first diaphragm 410*a* and the protector 500*a* when the first diaphragm 410*a* vibrates, the protector 500*a* has a step portion 530*a* protruding upward on the inner side of the upper surface 520*a*. In addition, a portion of the sidewall 510*a* of the protector 500*a* is removed to form a hole 512*a*, and a terminal for connection with an external terminal may be exposed through the hole 512*a*.

As described above, the frame 100*a* includes a pressure equilibrium groove 110*a* in which an outer portion is removed to avoid the position of the communication hole 212*a* of the yoke 210*a*, and accordingly, an air path that may communicate with the rear surface of the receiver is formed by the sidewall and the pressure equilibrium groove 110*a*.

Here, the upper surface 520*a* of the first protector 500*a* has a pressure equilibrium hole 522*a* that may communicate with the pressure equilibrium groove 110*a*. The pressure equilibrium hole 522*a* is located on an outer side than a contact portion between the first protector 500*a* and the first diaphragm 410*a*. In addition, a first sound emission hole 532*a* is provided in the center of the step portion 530*a* to emit sound reproduced by the first diaphragm 410*a*. Here, since the upper surface 520*a* is attached to the outer periphery of the first diaphragm 410*a*, the pressure equilibrium hole 522*a* and the first sound emission hole 532*a* do not communicate with each other.

Meanwhile, the first protector 500*a* includes a second sound emission hole 524*a* communicating with the communication hole 212*a* of the yoke 210*a*. The second sound emission hole 524*a* emits sound reproduced by the second speaker unit disposed below the yoke 210*a* upward.

In addition, a mesh 610*a* may be attached to the upper surface 520*a* of the first protector 500*a*. The mesh 610*a* may adjust the amount of air introduced through the pressure equilibrium hole 522*a* by adjusting a sieve scale. The mesh 610*a* may be attached to the first protector 500*a* by an adhesive member such as a double-sided tape 620*a*. Here, the double-sided tape 620*a* is not ventilated, and thus, the double-sided tape 620*a* should be perforated 622*a* not to block the pressure equilibrium hole 522*a*. In addition, the mesh 610*a* should not cover the second sound emission hole 524*a*.

Figure 9:
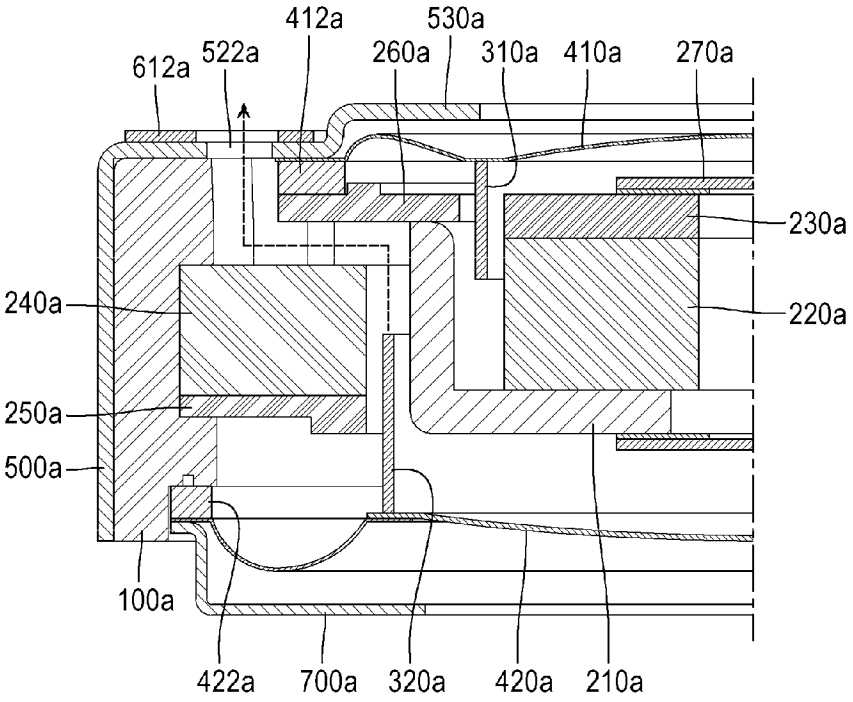
FIG. 9 is a cross-sectional view taken along line A-A of FIG. 8.

FIG. 9 is a cross-sectional view taken along line A-A of FIG. Referring to FIG. 9, a structure in which sound generated by the second speaker unit is emitted upwardly of the first protector 500*a* is shown.

Figure 10:
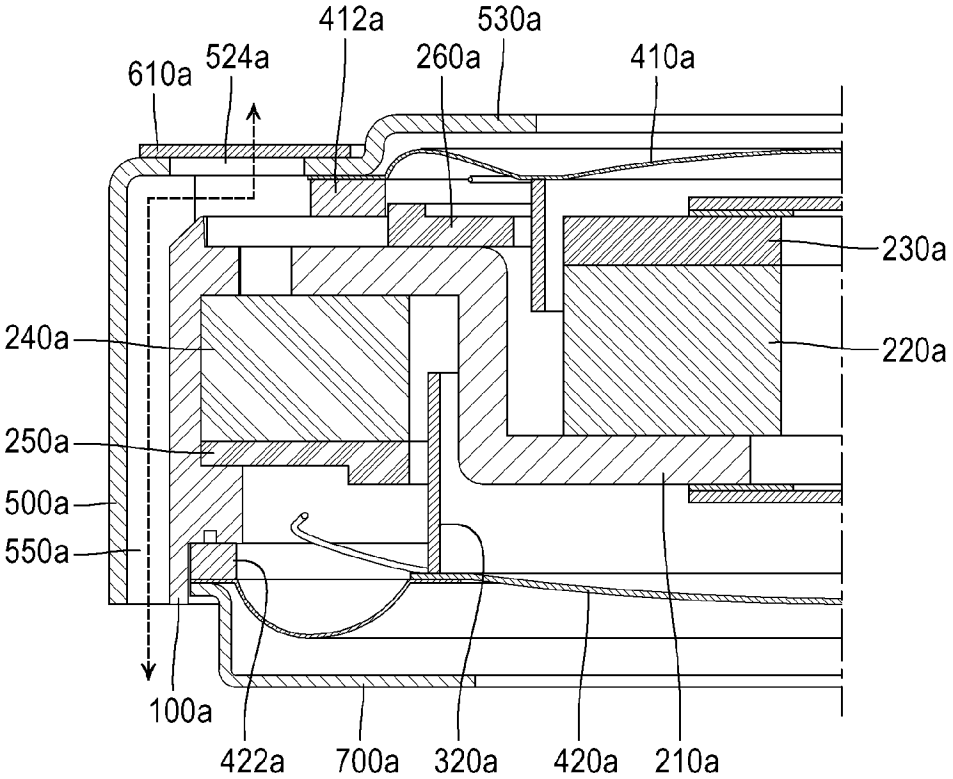
FIG. 10 is a cross-sectional view taken along line B-B of FIG. 8.

FIG. 10 is a cross-sectional view taken along line B-B of FIG. 8. Referring to FIG. 10, an air path 550*a* is formed by the pressure equilibrium groove 110*a* (refer to FIG. 7) formed by removing an outer portion of the first protector 500*a* and the frame 110*a*. Through the air path 550*a*, air may flow between the front of the receiver and the rear of the receiver, thereby achieving pressure equilibrium.

Figure 11:
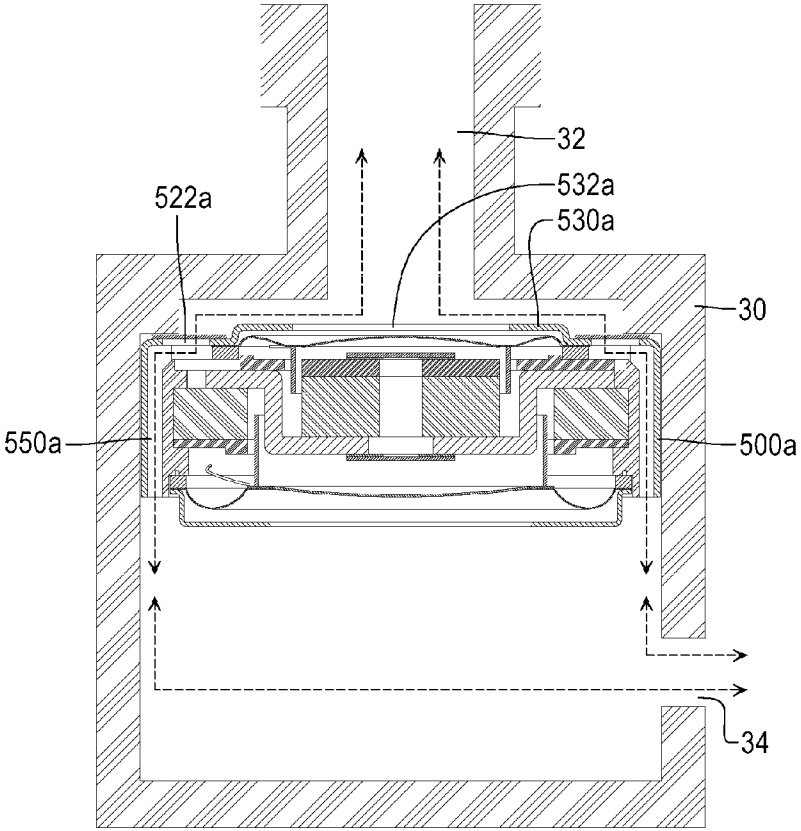
FIG. 11 is a view schematically illustrating a state in which the receiver having a pressure equilibrium structure according to the third embodiment of the present disclosure is installed in an earphone housing.

FIG. 11 is a diagram schematically illustrating a state in which a receiver having a pressure equilibrium structure according to the third embodiment of the present disclosure is installed in an earphone housing.

The receiver having a pressure equilibrium structure may be installed in an earphone housing 30. Here, the sidewall of the first protector 500*a* is attached or fixed to an inner surface of the earphone housing 30. A sound passage 32 for emitting sound to the user's ear is provided at the upper portion of the earphone housing 30. Sound of the first speaker unit is emitted upward through the first sound emission hole 532*a* formed in the center of the step portion 530*a* of the first protector 500*a*, and sound of the second speaker unit is emitted upward through the second sound emission hole 524*a* (refer to FIG. 8) and transmitted to the sound passage 32.

Here, air may flow between the upper and lower portions of the receiver in the housing 30, regardless of sound, through the air path 550*a* between the sidewall of the first protector 500*a* and the frame 100*a*, thereby achieving pressure equilibrium. Here, the housing 30 may include a ventilation hole 34 through which air may flow between the lower portion of the receiver and the outside.

The receiver itself has a pressure equilibrium structure, and since it is independent of the housing 30 and the pressure equilibrium structure installed with the receiver, that is, the air path 550*a*, the pressure equilibrium structure may be secured regardless of the shape and size of the housing 30. That is, since the housing 30 does not require a separate structure or a separate component for forming an air path, an efficient internal design may be made, which brings positive effects such as a reduction in a defect rate and shortening of a process time in production.

Figure 12:
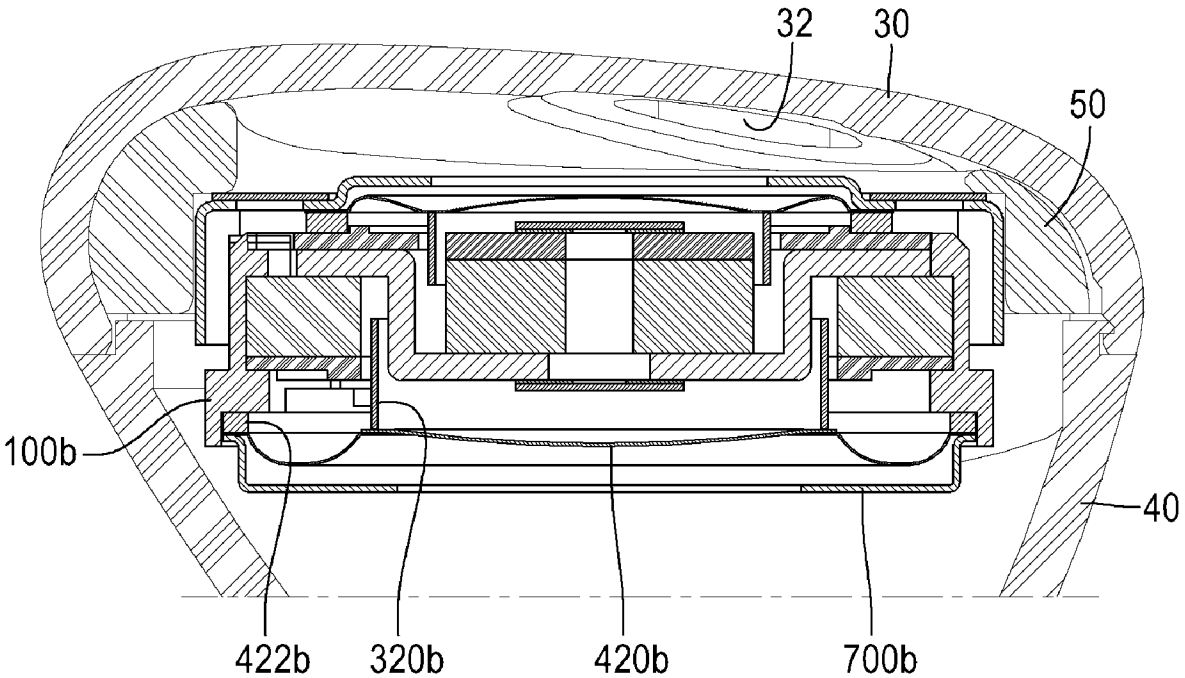
FIG. 12 is a view illustrating a state in which a receiver having a pressure equilibrium structure according to a fourth embodiment of the present disclosure is installed in an earphone housing.

FIG. 12 is a view illustrating a state in which a receiver having a pressure equilibrium structure according to a fourth embodiment of the present disclosure is installed in an earphone housing.

The receiver having a pressure equilibrium structure according to the fourth embodiment of the present disclosure is installed in an upper housing 30 and a lower housing 40, and the upper housing 30 has a sound passage 32 formed therein. In addition, a bracket 30 corresponding to a shape of the receiver may be additionally provided for installation of the receiver. In this embodiment, a first protector 500*b* surrounds only an upper portion of the side surface of the frame 100*b*, which is different from the third embodiment. Accordingly, a cross-section and volume of a portion not surrounded by the first protector 500*b* may be determined regardless of the size of the first protector 500*b*. Accordingly, the size of the cross-section or the volume may be increased. Also, in the fourth embodiment of the present disclosure shown in FIG. 12, a size of a lower portion of the frame 100*b* not surrounded by the first protector 500*b*, that is, a portion located below the second permanent magnet and the second top plate and a second diaphragm 420*b*, a second guide ring 422*b*, and a second protector 700*b* may be increased in size compared to the third embodiment. That is, since the area and volume of the diaphragm of the second speaker unit may be adjusted, there is an advantage in that the acoustic characteristics may be easily tuned while having a pressure equilibrium structure.

Figure 13:
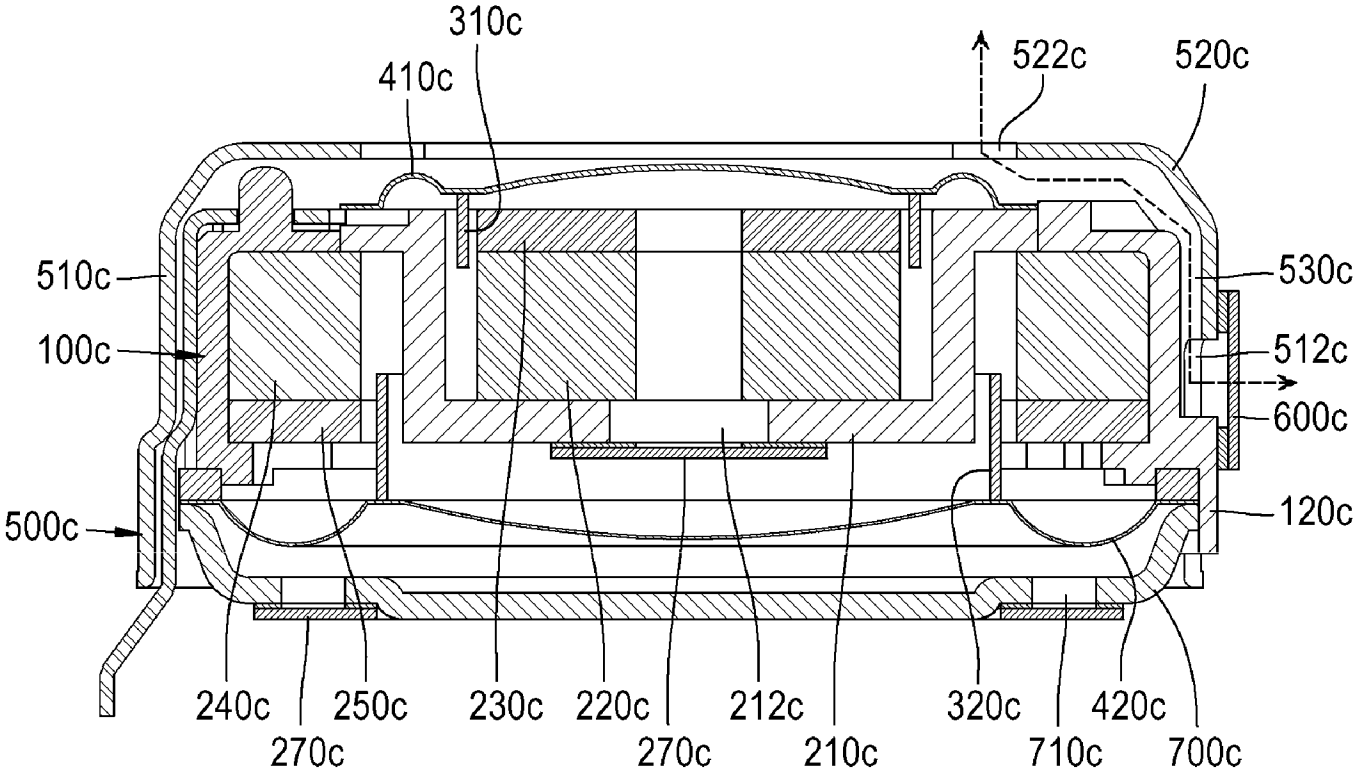
FIG. 13 is a cross-sectional view of a receiver having a pressure equilibrium structure according to a fifth embodiment of the present disclosure.
Figure 14:
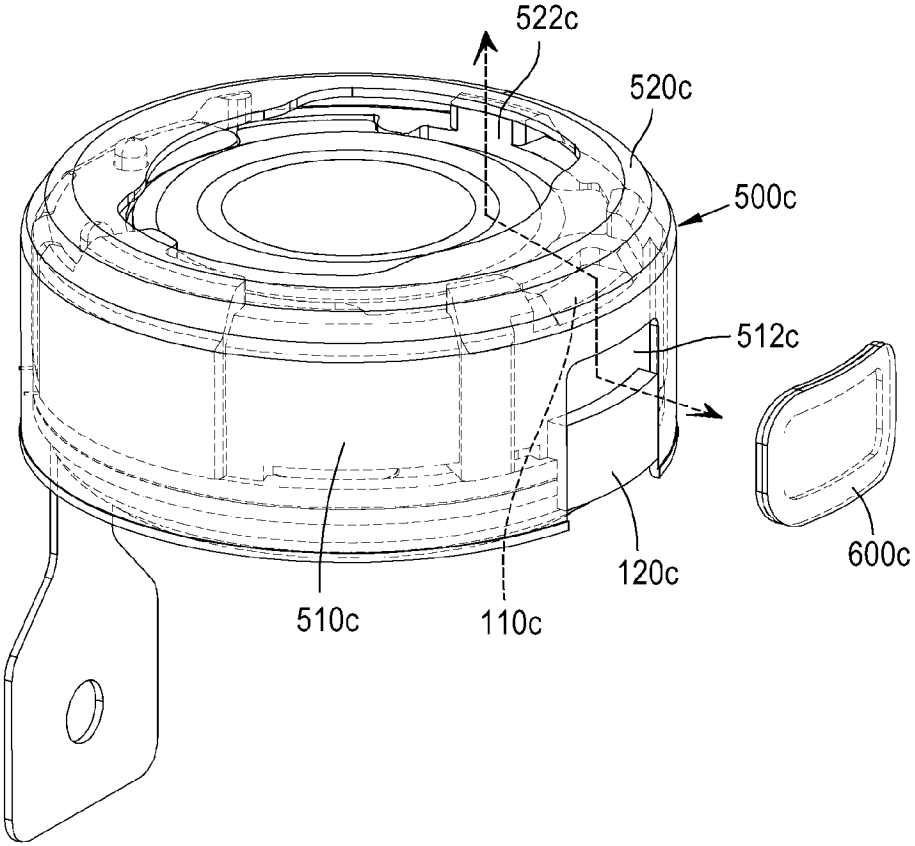
FIG. 14 is a perspective view of a receiver having a pressure equilibrium structure according to a fifth embodiment of the present disclosure.

FIG. 13 is a cross-sectional view of a receiver having a pressure equilibrium structure according to a fifth embodiment of the present disclosure, and FIG. 14 is a perspective view of a receiver having a pressure equilibrium structure according to the fifth embodiment of the present disclosure.

The receiver having a pressure equilibrium structure according to the fifth embodiment of the present disclosure includes a magnetic circuit and a vibrating unit in a cylindrical frame 100*c*. The frame 100*c* includes a yoke 210*c* partitioning an internal space of the frame 100*c* up and down. Based on the yoke 210*c* as a boundary, a first speaker unit is installed above the yoke 210*c*, and a second speaker unit is installed below the yoke 210*c*.

The yoke 210*c* includes a circular bottom surface, a cylindrical portion bent from the bottom surface, a flange portion formed on an outer circumference of the cylindrical portion, and a communication hole 212*c* formed by removing a portion of the flange portion.

A first speaker unit is installed above the yoke 210*c*, and the first speaker unit includes a first permanent magnet 220*c* attached to a bottom surface, a first top plate 230*c* attached to an upper surface of the first permanent magnet 220*c*, a first voice coil 310*c*, and a first diaphragm 410*c*. The outer periphery of the first permanent magnet 220*c* and the first top plate 230*c* is formed to be spaced apart from the cylindrical portion of the yoke 210*c*, and this space is a first magnetic gap. A lower end of the first voice coil 310*c* is positioned in the magnetic gap. An upper end of the first voice coil 310*c* is attached to the first diaphragm 410*c*, and the first diaphragm 410*c* vibrates according to vibration of the first voice coil 310*c* to generate sound. The first diaphragm 410*c* is attached to the flange portion of the yoke 210*c*.

Meanwhile, a second speaker unit is installed below the yoke 210*c*. The second speaker unit includes a second permanent magnet 240*c* positioned on a lower surface of the flange portion of the yoke 210*c* and a second top plate 250*c* attached to a lower surface of the second permanent magnet 240*c*. In this case, the second permanent magnet 240*c* and the second top plate 250*c* may be insert-injected during injection molding of the frame 100*c*. Here, the second permanent magnet 240*c* and the second top plate 250*c* have a ring shape, and an inner periphery is installed to be spaced apart from the cylindrical portion of the yoke 210*c*, and this space is a second magnetic gap. An upper end of the second voice coil 320*c* is positioned in the second magnetic gap, and a lower end of the second voice coil 320*c* is attached to the second diaphragm 420*c*. The outer periphery of the second diaphragm 420*c* is seated on the lower surface of the frame 100*c*.

In addition, a second protector 700*c* to protect the second speaker unit may be installed below the second speaker unit.

As described above, the yoke 210*c* includes a communication hole 212*c* formed by removing a portion of the flange portion. Sound generated by the second speaker unit is emitted upward through the communication hole 212*c*.

Meanwhile, the yoke 210*c*, the first permanent magnet 220*c*, and the first top plate 230*c* are perforated in the center and serve as a back hole. Accordingly, the first diaphragm 410*c* may vibrate smoothly. In this case, mesh 270*c* covering the perforation may be attached to the lower surface of the yoke 210*c*.

A first protector 500*c* protecting the first speaker unit and emitting sound is installed on the outside of the frame 100*c*. The first protector 500*c* has a sidewall 510*c* surrounding an outer surface of the frame 100*c* and an upper surface 520*c* surrounding a portion of the upper surface, and a sound emission hole 522*c* is formed in the center of the upper surface 520*c* of the first protector 500*c* to emit sound generated by the first diaphragm 410*c* and the second diaphragm 420*c*. A recess 110*c* is formed on the outer surface of the frame 100*c* so as to form an air path 530*c* with a gap from the inner surface of the first protector 500*c*. The recess 110*c* may communicate with the upper surface of the receiver, that is, air of the upper portion of the sound emission hole 522*c*.

Meanwhile, the air path 530*c* formed by the recess 110*c* and the first protector 500*c* is connected to a pressure equilibrium hole 514*c* at a lower end. The pressure equilibrium hole 514*c* is formed with a groove 512*c* extending to a lower end on the sidewall 510*c* of the first protector 500*c* facing the recess 110*c*. Here, the frame 100*c* has a guide 120*c* inserted into the groove 512*c*. The upper end of the guide 120*c* is spaced apart from the upper end of the groove 512 to form a pressure equilibrium hole 514*c* defined by the groove 512*c* and the guide 120*c*.

The air path 530*c* formed by the recess 110*c* and the first protector 500*c* connects the sound emission hole 522 of the upper surface of the first protector 520*c* and the pressure equilibrium hole 514*c*, and since external air enters and exits through the pressure equilibrium hole, a difference between pressure of an upper portion of the receiver, i.e., a portion inserted into an ear canal of the user, and external pressure may be adjusted.

Here, a mesh 600*c* may be attached to the pressure equilibrium hole 514*c* to adjust the amount of ventilation. By adjusting air ventilation of the mesh 600*c* as needed, acoustic characteristics may be adjusted without changing an overall receiver structure.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A receiver having a pressure equilibrium structure, the receiver comprising:

a magnetic circuit including a yoke, a permanent magnet coupled to the yoke, and a top plate attached to the permanent magnet;

a voice coil configured to vibrate by mutual electromagnetic force with the magnetic circuit;

a diaphragm allowing the voice coil to be attached thereto and vibrated by the voice coil to generate sound; and a protector coupled to an upper surface of the diaphragm and surrounding an outer side of the magnetic circuit with a gap from an outer periphery of the magnetic circuit, wherein the protector has a hole communicating with a gap portion with the magnetic circuit and an air path is formed by the hole of the protector and the gap between the magnetic circuit and the protector.

2. The receiver of claim 1, further comprising:

a mesh covering a pressure equilibrium hole of the protector.

3. A receiver having a pressure equilibrium structure, the receiver comprising:

a cylindrical frame having a gap configured to accommodate a component;

a yoke partitioning an internal space of the frame vertically and including a bottom surface, a cylindrical portion bent from the bottom surface, a flange portion formed on an outer circumference of the cylindrical portion, and a communication hole formed by removing a portion of the flange portion;

a first speaker unit installed above the yoke and including a first permanent magnet, a first plate, a first voice coil, and a first diaphragm;

a second speaker unit installed below the yoke and including a second permanent magnet, a second plate, a second voice coil, and a second diaphragm;

a first protector coupled to an upper surface and a side surface of the frame and protecting the first speaker unit; and an air path formed by removing portions of the upper surface and the side surface of the frame to have a gap from the first protector, wherein the first protector has a pressure equilibrium hole communicating with the air path.

4. The receiver of claim 3, further comprising:

a mesh attached to the pressure equilibrium hole of the first protector.

5. The receiver of claim 3, wherein the first protector includes a second sound emission hole communicating with the communication hole of the yoke.

6. The receiver of claim 3, further comprising:

a third plate attached to an upper surface of the flange portion of the yoke and helping to install the first diaphragm.

7. The receiver of claim 6, wherein the first protector includes:

a side surface coupled to the side surface of the frame;

an upper surface attached to the upper surface of the frame and an outer periphery of the first diaphragm; and a step portion protruding upward to avoid interference with the first diaphragm.

8. The receiver of claim 7, wherein the step portion has a first sound emission hole emitting sound reproduced by the first diaphragm.

9. The receiver of claim 3, wherein the first protector includes a side surface coupled to the side surface of the frame and an upper surface coupled to the upper surface of the frame and an outer periphery of the diaphragm.

10. The receiver of claim 3, further comprising:

a second protector attached to the side surface of the frame and a lower surface of the second diaphragm and protecting the second speaker unit.

11. The receiver of claim 3, wherein the first protector surrounds only a portion of an upper side of the side surface of the frame.

12. The receiver of claim 11, wherein a cross-section and a volume of a portion of the frame not surrounded by the first protector and at least a portion of the second speaker unit are determined irrespective of the first protector.

13. A receiver having a pressure equilibrium structure, the receiver comprising:

a cylindrical frame having a gap configured to accommodate a component;

a yoke partitioning an internal space of the frame vertically and including a bottom surface, a cylindrical portion bent from the bottom surface, a flange portion formed on an outer circumference of the cylindrical portion, and a communication hole formed by removing a portion of the flange portion;

a first speaker unit installed above the yoke and including a first permanent magnet, a first plate, a first voice coil, and a first diaphragm;

a second speaker unit installed below the yoke and including a second permanent magnet, a second plate, a second voice coil, and a second diaphragm;

a first protector coupled to an upper surface and a side surface of the frame and including a sound emission hole protecting the first speaker unit and configured to emit sound and a pressure equilibrium hole formed by removing a portion of a sidewall to a lower end; and an air path having a gap with the first protector by removing portions of the upper surface and the side surface of the frame, and extending from the sound emission hole to the pressure equilibrium hole.

14. The receiver of claim 13, wherein the frame has a guide protrusion inserted into a lower end of a groove, and wherein the pressure equilibrium hole is defined by a removed groove of the first protector.

15. The receiver of claim 14, further comprising:

a mesh attached to the pressure equilibrium hole and adjusting an amount of ventilation.

* * * * *